United States Patent [19]

Summers et al.

[11] Patent Number: 4,730,842

[45] Date of Patent: Mar. 15, 1988

[54] ADJUSTABLE WHEELCHAIR

[75] Inventors: Patrick D. Summers, West Simsbury; Richard A. Eden, Bloomfield, both of Conn.

[73] Assignee: Wheel Ring, Inc., Manchester, Conn.

[21] Appl. No.: 82,990

[22] Filed: Aug. 5, 1987

Related U.S. Application Data

[63] Continuation of Ser. No. 853,402, Apr. 18, 1986, abandoned.

[51] Int. Cl.[4] ..... A61G 5/00

[52] U.S. Cl. ..... 280/638; 280/42; 280/657; 297/433; 297/DIG. 4

[58] Field of Search ..... 280/242 WC:638, 35, 280/42, 656, 657; 297/433, 436, DIG. 4

[56] References Cited

U.S. PATENT DOCUMENTS

| | | | |
|---|---|---|---|
| 1,177,290 | 3/1916 | Tollstam | 280/293 |
| 2,953,390 | 9/1960 | Hogstrom | 280/656 |
| 3,337,261 | 8/1967 | Nihlean et al. | 297/433 X |
| 3,376,067 | 4/1968 | Kernes | 297/433 X |
| 3,666,292 | 5/1972 | Bartos | 280/234 |
| 3,937,490 | 2/1976 | Mohamed | 280/242 WC |
| 3,968,991 | 7/1976 | Maclaren | 297/45 |
| 4,082,348 | 4/1978 | Haury | 297/45 |
| 4,264,085 | 4/1981 | Volin | 280/242 WC |
| 4,351,540 | 9/1982 | Minnebraker | 280/242 WC |
| 4,360,213 | 11/1982 | Rudwick | 280/242 WC |
| 4,405,142 | 9/1983 | Whetstine | 280/242 WC |
| 4,428,594 | 1/1984 | Minnebraker | 280/242 WC |
| 4,431,076 | 2/1984 | Simpson | 280/242 WC |
| 4,462,604 | 7/1984 | Meyer | 280/242 WC |
| 4,477,098 | 10/1984 | Minnebraker | 280/242 WC |
| 4,500,102 | 2/1985 | Haury et al. | 280/242 WC |
| 4,515,383 | 5/1985 | Minnebraker | 280/242 WC |

FOREIGN PATENT DOCUMENTS

| | | | |
|---|---|---|---|
| 529233 | 6/1954 | Belgium | 280/242 WC |

*Primary Examiner*—John A. Pekar

*Attorney, Agent, or Firm*—Finnegan, Henderson, Farabow, Garrett & Dunner

[57] ABSTRACT

An adjustable wheelchair comprising a supporting frame having a front, a rear and a pair of sides defining a seat portion inbetween; a pair of main wheels rotatably mounted to the frame and a pair of secondary wheels rotatably mounted to the frame for pivotal movement with respect thereto. The frame includes a series of split clamps for continuous adjustment of the width of the seat portion over a defined range. A cushion is fastened to the seat portion by means of a pair of overlapping flexible supports having Velcro material thereon for joining the supports of varying degrees of overlap. The main wheels and secondary wheels are adjustable in both vertical and horizontal directions, and the chair is collapsible horizontally as opposed to vertically. The armrests are rotatable for allowing the chair back to be collapsed. A pair of footplates are swingably mounted to the frame for pivotal movement and the footplates may also be adjusted to varying degrees of inclination with respect to a horizontal plane.

10 Claims, 5 Drawing Figures

FIG. 3.
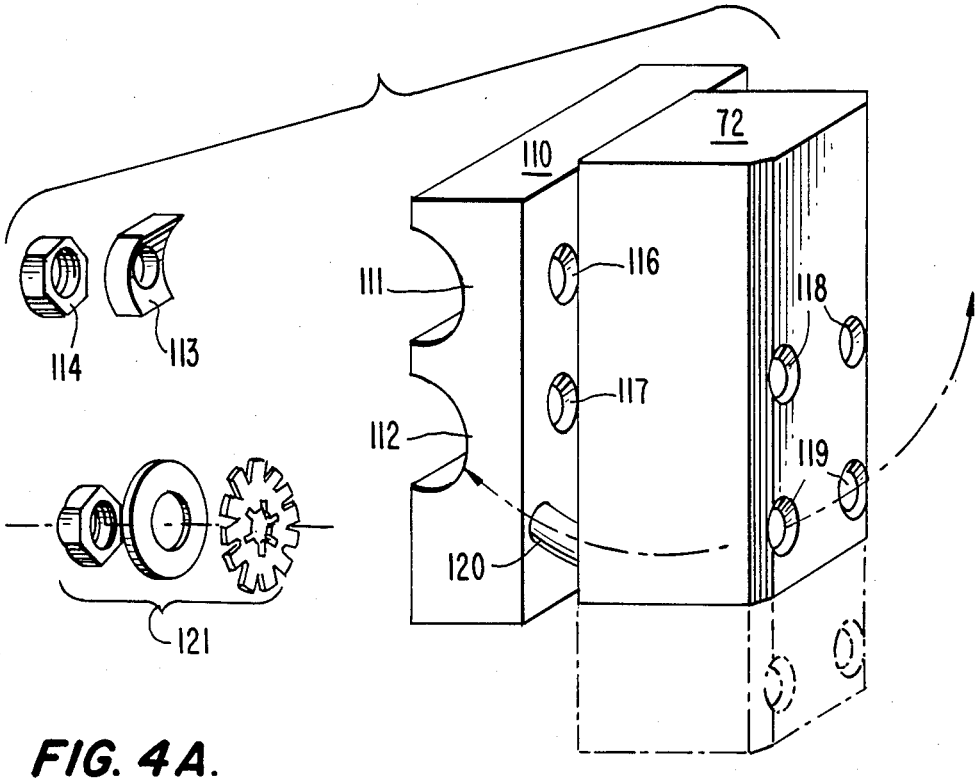
FIG. 4A.
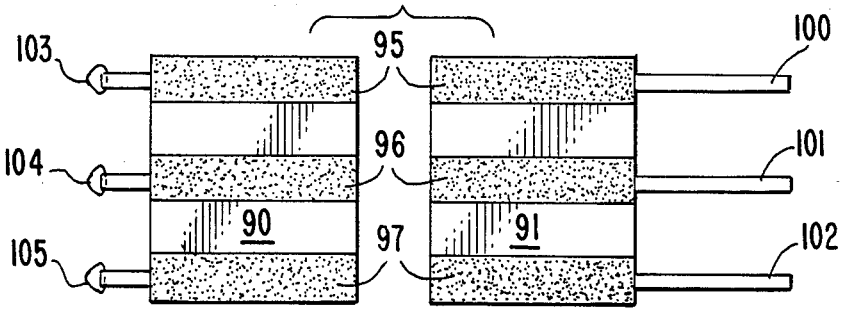
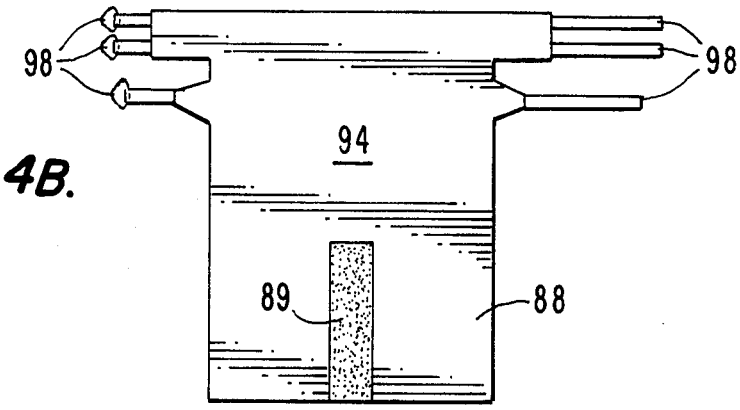
FIG. 4B.

ADJUSTABLE WHEELCHAIR

This application is a continuation, of application Ser. No. 853,402, filed Apr. 18, 1986, now abandoned.

FIELD OF THE INVENTION

This invention relates generally to wheelchairs and more specifically to wheelchairs which are adjustable to accommodate changes in the size of an individual, such as a growing child.

BACKGROUND OF THE INVENTION

Wheelchairs which include various features of adjustability have been known in the prior art for some time. For example, Nasr U.S. Pat. No. 3,937,490 describes a wheelchair having a seat which is vertically adjustable, and which has some other features of adjustability. Haury U.S. Pat. No. 4,082,348 discloses a collapsible wheelchair having an X-frame wherein the frame members are telescopically adjustable with respect to each other. Various other arrangements have been described in the prior art for allowing adjustment of certain parameters of a wheelchair. Despite these and other prior art efforts, there is still a substantial problem in the wheelchair art of accommodating children, particularly small children, with a suitable wheelchair which can be expanded in varying ways to accommodate the growth of the child.

Accordingly, it is a primary object of this invention to provide a new and improved adjustable wheelchair in which the width of the seat portion is continuously adjustable over a wide defined range.

It is a further object of this invention to allow for vertical adjustment of the wheelchair seat relative to the surface on which the wheels of the chair are supported.

Another object of the invention is to provide a novel Velcro fastening structure for supporting the cushion of the wheelchair seat.

It is a further object of the invention to easily collapse an adjustable wheelchair horizontally as opposed to vertically. An additional object of the invention is to support the feet of a seated occupant of the wheelchair at a variety of inclinations relative to the horizontal.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the purposes of the invention as embodied and broadly described herein, the adjustable wheelchair of this invention comprises a supporting frame having a front, a rear, and a pair of sides defining a seat portion therebetween; a pair of main wheels rotatably mounted to the frame, and a pair of secondary wheels rotatably mounted to the frame for pivotal movement with respect thereto. The frame includes means for continuous adjustment of the width of the seat portion over a defined range. Seat means are fastened to the seat portion for receiving a human in a seated position.

Preferably, the seat means includes a cushion with at least one adjustable strap for supporting the cushion. It is also preferred that the seat means include a pair of overlapping flexible supports, and Velcro material for joining the supports at varying degrees of overlap.

The frame preferably includes a plurality of corresponding pairs of crossbars, and the width adjusting means may include split clamp means for adjustably joining each of the corresponding pairs of crossbars. This split clamp means is preferably formed of nylon for providing greater shock absorption.

The adjustable wheelchair also may include means for adjusting the positions of the main wheels and the secondary wheels on the frame for raising and lowering the seat portion. The wheel adjusting means may also include means for increasing and decreasing the distance between the main and secondary wheels on a generally horizontally plane.

A back portion preferably extends generally vertically from the frame, and means for collapsing the back portion to a generally horizontal orientation over the seat cushion are provided. The wheelchair also may include a pair of armrests, and means for detachably securing the armrests to the frame. The armrests may be provided with rotating means for moving them vertically when the back portion is collapsed to its generally horizontal orientation.

Preferably, the wheelchair also includes support means mounted to the frame for supporting the feet of a human. The foot support means may include a pair of footplates swingably mounted to the frame for pivotal movement between the first position wherein the footplates extend outward from the frame, and the second position when the footplates are oriented toward the frame for allowing access to the seat portion without substantial interference from the footplates. Preferably, the support means also includes means for maintaining the footplates in a substantially horizontal orientation when they are pivoted between the first and second positions, and ratchet means may also be provided for adjusting the inclination of the footplates with respect to a substantially horizontal plane.

The wheelchair also preferably includes anti-tip means on the rear of the frame for maintaining the wheelchair in an upright position on the wheels when the chair is subjected to tipping forces. The anti-tip means may include an angled member extending from the frame and at least one wheel mounted to the end of the member for counteracting the tipping motion of the chair. Means for pivoting the angled member between a first position wherein the member extends from the rear of the frame and a second position wherein the member is substantially within the frame may also be included.

BRIEF DESCRIPTION OF THE DRAWINGS

The accompanying drawings, which are incorporated and constitute a part of this specification, illustrate one embodiment of the invention and, together with the description, serve to explain the principles of the invention.

Of the Drawings

FIG. 3 is an exploded perspective view of the caster housing assembly of the invention used for mounting the secondary wheels; and FIG. 4A and FIG. 4B are top views of the adjustable flexible support system for the seat cushion and back cushion, respectively.

DESCRIPTION OF THE PREFERRED EMBODIMENT

Figure 1:
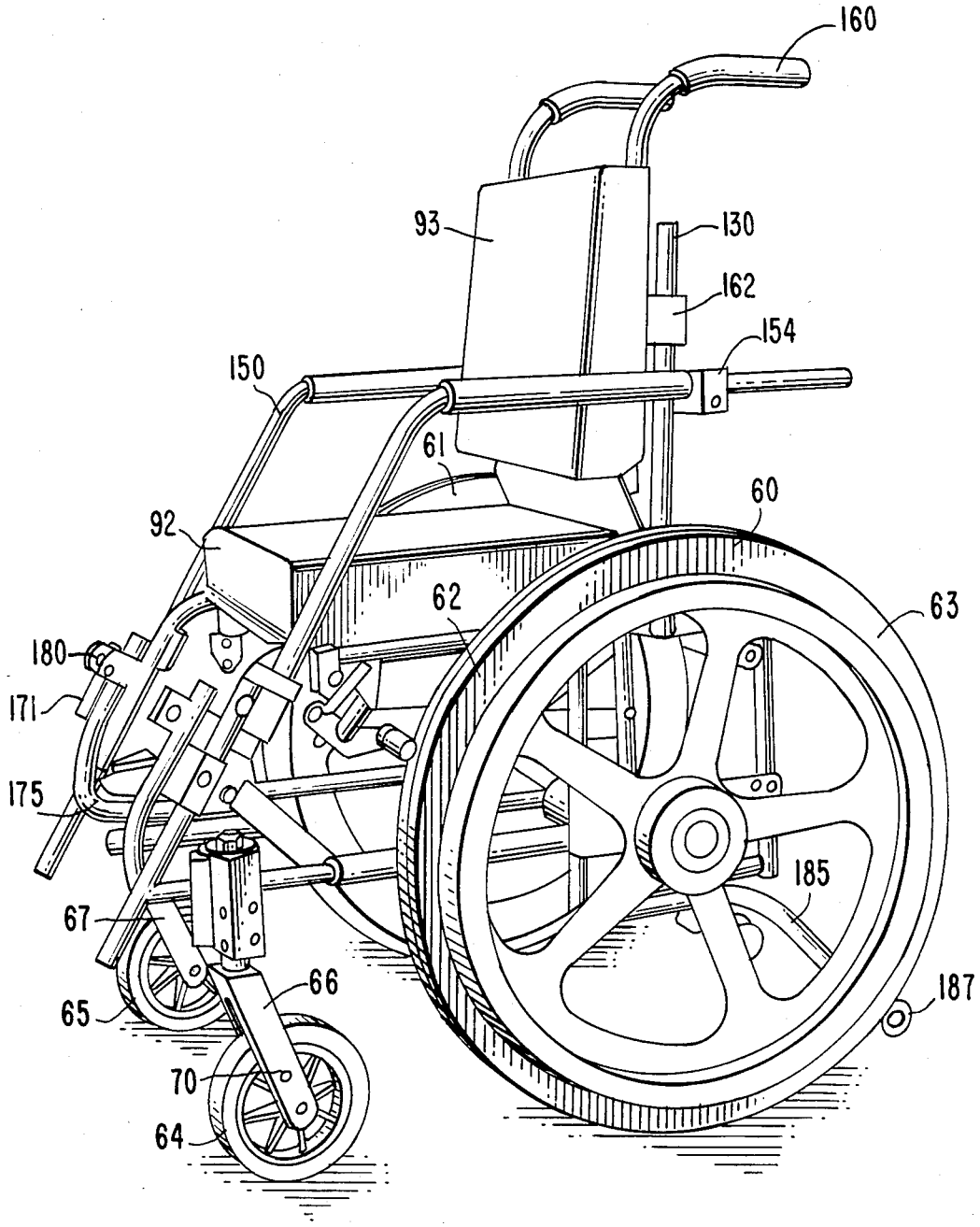
FIG. 1 is a perspective view of the adjustable wheelchair fo the invention.

Reference will now be made in detail to the present preferred embodiment of the invention, an example of which is illustrated in the accompanying drawings. Referring to FIG. 1, it may be seen that the adjustable wheelchair of the present invention provides a simple and effective means for adjusting the width and height of a wheelchair to accommodate persons of varying size, or a growing child. In accordance with the invention, the adjustable wheelchair generally includes a supporting frame, having a front, a rear and a pair of sides defining a seat portion therebetween. As embodied herein, a frame 20 is preferably formed of a series of tubular members, joined at various locations. In the illustrated embodiment, a pair of similar side sections 21 and 22 form the opposite sides of the frame. Each of the side sections 21 and 22 includes a top bar 23 and 24 having a horizontally disposed portion 25, 26 and a front portion 27, 28 which is angled downwardly with respect to the horizontally disposed portions 25 and 26. Each of the sides 21 and 22 also includes a pair of generally vertically disposed main wheel support members 30, 31, 32 and 33. The main wheel support members 30 and 31 are fixed to the top bar 23 on the horizontal portion 25, and extend downwardly therefrom, and the main wheel support members 32 and 33 are similarly attached to the top bar 24. A bottom member 35, 36 is fixed to each of the respective pairs of main wheel support members 30, 31 and 32, 33. An axle plate 38 is bolted to each pair of main wheel support members 30, 31 and 32, 33 through a series of holes 40 in the main wheel support members. A plurality of holes 40 are provided in each of the main wheel support members to allow the axle plates 38 to be adjusted upwardly or downwardly on the main wheel support members 30, 31, 32 and 33. An elongated slot 42 is provided in each of the axle plates 38. An axle nut 44 is mounted in each of the slots 42 for slidable movement along the elongated slot. This allows for adjustment of the position of the axle nut 44 at varying locations along the slot 42. A bushing 46 is mounted within the axle nut 44 for receiving a wheel shaft discussed hereinafter.

A lower bar 51 extends generally horizontally from the main wheel support member 31, and a similar lower bar 52 extends from the main wheel support member 33. The lower bar 51 is fixed at one end to the main wheel support member 31 and at the opposite end to the angled front portion 27 of the top bar 23. Similarly, lower bar 52 is fixed at one end to the main wheel support member 33 and at the opposite end to the angled front portion 28 of the top bar 24. Thus, each side of the frame forms a rigid member of corresponding structure.

In accordance with the invention, a pair of main wheels are rotatably mounted to the frame, and a pair of second wheels are also rotatably mounted to the frame for pivotal movement with respect thereto. As embodied herein, and as shown in FIG. 1, a pair of main wheels 60 and 61 are rotatably mounted to the frame 20 through axle nuts 44 and bushings 46. Each of the main wheels 60 and 61 includes a wear resistant surface 62 and a tubular member 63 mounted in spaced relation to the wear resistant surface 62 for allowing manual rotation of the main wheels 60 and 61.

In the illustrated embodiment, a pair of secondary wheels 64 and 65 are rotatable mounted to forks 66 and 67 by means of an axle 68. Each of the forks 66 and 67 includes a plurality of holes 70 for accommodating the axle 68 in multiple positions. The forks 66 and 67 are each rotatably mounted to a caster housing 72 by means of an elongated bolt (not shown) and a suitable nut 74. This allows the forks 66 and 67 to rotate 360° with respect to the caster housing 72.

Figure 2:
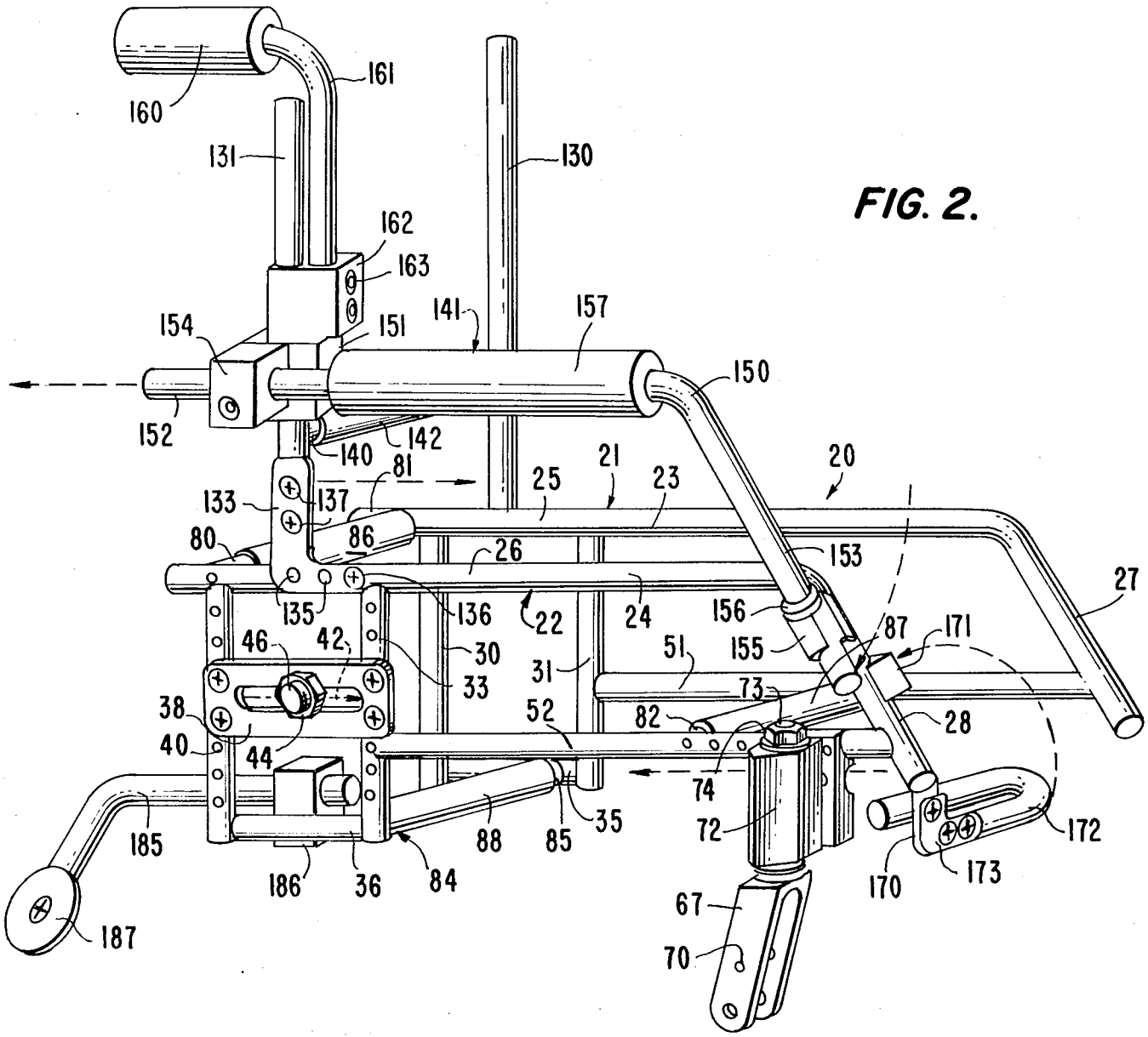
FIG. 2 is an exploded cutaway view of the frame of the invention showing the various means for adjustment.

In accordance with the invention, the frame includes means for continuous adjustment of the width of the seat portion over a defined range. Preferably, the frame includes a plurality of corresponding pairs of crossbars, and the width adjusting means includes split clamp means for adjustably joining each of the corresponding pairs of crossbars. As embodied herein, and as shown in FIG. 2, the means for continuous adjustment of the width of the seat portion includes three corresponding pairs of crossbars. Crossbars 80 and 81 are joined to the respective top bars 23 and 24 and extend generally horizontally toward each other. Similarly, crossbars 82 and 83 are joined to lower bars 51 and 52 and extend generally horizontally toward each other, and crossbars 84 and 85 are joined to bottom bars 36 and 35, respectively, and also extend generally horizontally toward each other. Each of these corresponding pairs of crossbars is joined by a split clamp 86, 87, 88 which is preferably formed of machined nylon. This split clamp arrangement allows the distance between the sides of the frame to be adjusted over a wide range to accommodate varying circumstances.

In accordance with the invention, seat means are fastened to the seat portion for receiving a human in a seated position. Preferably, the seat means includes a cushion and at least one adjustable strap for supporting the cushion. In the illustrated embodiment, a pair of flexible overlapping supports 90 and 91 are provided for supporting a seat cushion 92 at varying degrees of overlap. Each of the flexible supports 90 and 91 includes Velcro material for joining the supports at different points of overlap. As shown in FIG. 4A three strips of Velcro 95, 96 and 97 may be provided across the width of each of the flexible supports. Each of the supports 90 and 91 also includes at least one adjustable strap for further supporting the cushion. In the illustrated embodiment of FIG. 4, three straps 100, 101, and 102 and three corresponding D-ring fasteners 103, 104 and 105 are provided. This arrangement allows easy adjustment of the width of the flexible supports when the width of the frame is changed by means of the split clamp arrangement.

As discussed above, the main wheel 60, 61 may be adjusted horizontally by loosening the axle nut 44 and moving it within the slot 42. In addition, the position of the secondary wheels 64 and 65 may also be adjusted horizontally by means of the unique design of the caster housing 72 and its related assembly.

As shown in FIG. 3, the caster housing 72 may be attached to a caster housing clamp 110 which in turn is attached to the lower bar 51, 52. A pair of rounded grooves 111, 112 are provided for close fitting relation to the lower bar 51, 52. The caster housing clamp 110 is held in place on the bar 51, 52 by means of a suitable radius washer 113 and a nyloc nut 114. Upper screw holes 116 and lower screw holes 117 are utilized for firmly clamping the caster housing 110 against the lower bars 51, 52. Thus, the position of the secondary wheels 64 and 65 may also be adjusted by moving the mounting point of the caster housing clamp from the groove 111 to the groove 112. This provides additional flexibility to the multiple holes 70 in the forks 66 and 67.

The structure of the caster housing assembly allows a variety of different adjustments of the position of the secondary wheels with at least eight vertical positions and two horizontal positions on the frame and a fine adjustment possible in each position. As shown in FIG. 3, the caster housing 72 has a pair of upper screw holes 118 and a pair of lower screw holes 119, either of which may be selected for mounting the caster housing 72 to the caster housing clamp 110. The caster housing is attached to the caster housing clamp by means of suitable bolts (not shown) through the selected pair of screw holes 118, 119. The bolts pass through oversized holes 120 in the caster housing clamp 110 for allowing up to a 5° pivoting of the caster housing 72 in either direction to compensate for slight slope angle between the main and secondary wheels of the wheelchair. The bolts are fastened with suitable nuts and washers 121 to hold them firmly against the caster housing clamp 110.

In accordance with the invention, the adjustable wheelchair also includes a back portion extending generally vertically from the frame, and means for collapsing the back portion to a generally horizontal orientation. The wheelchair also includes a pair of armrests, and means for detachably securing the armrests to the frame, and means for rotating the armrests vertically to allow the back portion to be collapsed to the generally horizontal position. As shown in FIG. 2, the back portion includes a pair of back tubes 130 and 131 exending generally vertically from the top bars 23 and 24. In the illustrated embodiment, the means for collapsing the back portion includes a pair of back rest brackets 133 for pivotally attaching the back tubes 130 and 131 to the top bars 23 and 24. As shown in FIG. 3, the back rest brackets 133 include a plurality of holes 135 for attaching the brackets 133 to the top bars 23, 24 at varying locations. A bolt 136 rotatably fastens the back rest bracket 133 to the top bar 24 so that the back tube 131 can be pivoted on the top bar 24 to a generally horizontal position generally parallel thereto. A pair of bolts 137 secures each of the top bars 130, 131 to a back rest bracket 133.

A pair of corresponding back support members 140, 141 extend generally horizontally from each of the back tubes 130 and 131 toward each other. The back support member 140 is attached at one end to the back tube 131 and the back support member 141 is similarly attached at one end to the back tube 130. A nylon split clamp 142 similar to the split clamps 86, 87 and 88 adjustably joins the back supporting members 140 and 141 together.

As shown in FIG. 2, a pair of armrests 150 are pivotally mounted via an armrest clamp 151 to the back tubes 130, 131. The armrest 150 includes an angled tube having a top portion 152 and a bottom portion 153. The top portion is mounted to an armrest swivel 154 for pivotal movement on the armrest clamp 151. The bottom portion 153 is angled for alignment with the angled front portion 28 of the top bar 24 when the armrest is in position. An armrest lock 155 detachably clamps the bottom portion of the armrest 153 in place against the front portion 28 of the top bar. An armrest stop 156 helps to align the armrest for proper insertion into the armrest lock 155. A suitable cushioning material 157 may also surround the armrest 150.

A pair of handles 160 may also be attached to the back tubes 130 and 131 for facilitating the pushing of the wheelchair. Handles 160 and include an L-shaped tube 161 which is attached to a back clamp 162 by means of a screw 163. A back clamp 162 is adjustably attached to each of the back tubes 130 and 131 by means of another screw (not shown).

In accordance with the invention, the wheelchair also includes support means mounted to the frame for supporting the feet of a human. The support means preferably includes a pair of footplates swingably mounted to the frame for pivotal movement between a first position wherein the footplates extend outward from the frame and the second position wherein the footplates are oriented toward the frame for allowing access to the seat portion without substantial interference from the footplates.

In the illustrated embodiment, a pair of foot tubes 170 are adjustably attached to the front portion 27, 28 of the top bars 23 and 24. A footplate clamp 171 secures the foot tube to the bar 23, 24. A U-shaped tube 172 is pivotally mounted to the foot tube 170 by means of a footplate bracket 173. The U-shaped tube 172 may be pivoted on the footplate bracket between up and down positions, and the tube 170 may also be rotated with respect to the footplate clamp for turning the footplate bracket 173 inwardly or outwardly with respect to the frame 20. As shown in FIG. 1, a footplate 175 is mounted to the U-shaped tube 172 for supporting the feet of a person seated in the chair.

In accordance with the invention, ratchet means may be provided for adjusting the inclination of the footplate with respect to a substantially horizontal plane. As embodied herein, and as shown in FIG. 1, the ratchet means includes a ratchet clamp 180 including an internally disposed ratchet mechanism for allowing the inclination of the foot tubes 170 to be adjusted incrementally through an angle of about 90°. This allows the footplates 175 to be disposed at varying angles for accommodating wheelchair occupants having different requirements.

In accordance with the invention, the wheelchair also includes anti-tip means for maintaining the wheelchair in an upright position on the wheels when the chair is subjected to tipping forces. As embodied herein, and as shown in FIGS. 1 and 2, the anti-tip means includes an angled tube 185 attached via an anti-tipping clamp 186 to crossbar 84. A wheel 187 is rotatably mounted on one end of the angled member 185, and it is preferred that a pair of such wheels be coaxially mounted on each angled member 185 for additional stability. The angled member 185 may be quickly and easily rotated on the crossbar 84 from its activated position extending from the rear of the wheelchair to a deactivated position wherein the angled member 185 and the wheel 187 are disposed within the outline of the frame 20.

As discussed above, the adjustable wheelchair of this invention includes multiple means for adjusting the wheelchair to accommodate occupants of a variety of sizes and shapes. The width of the seat is adjusted by spreading the frame on the split clamps 86, 87, 88 and 142 and by adjusting the straps and flexible supports under the seat cushion. As best seem in FIG. 4B, a back cushion 93 is also supported by a flexible support 94. The support 94 includes an elongated tongue 88 having a Velcro strip 89 thereon for joining with the Velcro strips 95, 96 or 97 on the supports 90 and 91. A plurality of straps 98 and associated D-rings provide for adjustment of the flexible back support when the width of the seat portion is changed. The cushion 93 attaches to the support 94 by a similar Velcro arrangement.

As discussed above, the position of the main wheels 60 and 61 may be adjusted both vertically and horizontally by moving the axle plate 38 on the main wheel support members 32 and 33, and by moving the axle nut 44 in the slot 42. Similarly, the secondary wheels 64 and 65 may be relocated by changing the mounting position of the caster housing clamp 110 on the lower bar 51, 52, or by changing the mounting position of the caster housing 72 on the caster housing clamp. Further adjustments of the secondary wheels 64, 65 may be made by moving the wheels to a different mounting hole 70 in the forks 66, 67. In addition, further adjustments may be made to the position of the wheels 64, 65 by pivoting the caster housing 72 with respect to the caster housing clamp 110.

The wheelchair may be folded for easy storage by unclamping the armrests 150 from the armrest locks 155, pivoting the armrest 150 on the armrest swivels 154 and collapsing the back tubes 130 and 131 by means of the back rest brackets 133 to a generally horizontal orientation over the seat cushion 92. The precise location of the back tubes 130 and 131 may also be adjusted by moving the mounting point of the back rest bracket 133 on the top bars 23 and 24. Also, the position of the armrest 150 and the handle 160 may be adjusted to accommodate varying conditions.

The various features of the foot support mechanism are extremely important to the present invention. In particular, children often have a difficult time in mounting or dismounting from a wheelchair. Accordingly, the varying features of adjustability of the position of the footplates 175 allows for use by individuals of many different sizes and disabilities.

It will be apparent to those skilled in the art that various modifications and variations could be made in the adjustable wheelchair of the invention without departing from the scope or spirit of the invention.

What is claimed is:

1. A horizontally adjustable wheelchair comprising:

a supporting frame having a front, a rear, and a pair of sides defining a seat portion therebetween;

a pair of main wheels rotatably mounted to said frame, and a pair of secondary wheels rotatably mounted to said frame for pivotal movement with respect thereto;

said frame including means for continuous adjustment of the width of said seat portion over a defined range; and seat means fastened to said seat portion for receiving a human in a seated position, wherein said frame includes a plurality of corresponding pairs of crossbars, each of said crossbars of a respective pair being fixed by attached to a respective one of said frame sides, and said width adjusting means includes continuously adjustable split clamp means for adjustably joining each of said corresponding pair of crossbars.

2. The adjustable wheelchair of claim 1 wherein said split clamp means is nylon.

3. The ajdustable wheelchair of claim 1, wherein said frame includes three of said corresponding pairs of crossbars, said three pairs of crossbars being located at the vertices of a triangle when viewed in a plane parallel to said frame sides.

4. A adjustable wheelchair comprising:

a supporting frame having a front, a rear, and a pair of sides defining a seat portion therebetween;

a pair of main wheels rotatably mounted to said frame, and a pair of secondary wheels rotatably mounted to said frame for pivotal movement with respect thereto;

said frame including means for continuous adjustment of the width of said seat portion over a defined range;

seat means fastened to said seat portion for receiving a human in a seated position;

a back portion extendng genreally vertically from said frame, and means for collapsing said back portion to a generally horizontal orientation;

a pair of arm rests, said collapsing means including means for detachably securing said arm rests to said frame; and means for rotating said arm rests vertically for collapsing said back portion to said generally horizontal orientation.

5. An adjustable wheelchair providing improved frontal access for small children, the wheelchair comprising:

a supporting frame having a front, a rear, and a pair of sides defining a seat portion therebetween;

a pair of main wheels rotatably mounted so said frame, and a pair of secondary wheels rotatably mounted to said frame for pivotal movement with respect thereto;

seat means fastened to said seat portion for receiving a human in a seated position, wherein said frame sides have respective side members extending forwardly of said seat portion, the space to the front of said and between said side members defining the route for frontal access; and support means mounted to said frame for supporting the feet of a human, wherein said foot support means includes a pair foot-tubes with respective depending footplates rotatably mounted to said frame side members for pivotal movement about the respective axes of said foot-tubes, between a first position wherein said footplates extend outward from said frame, and a second position wherein said footplates are oriented toward said frame, for allowing frontal access to said seat portion when in said first position without substantial interference from said footplates.

6. The adjustable wheelchair of claim 5 wherein said support means includes means for maintaining said footplates in a substantially horizontal orientation when pivoted between said first and second positions.

7. The adjustable wheelchair of claim 5 wherein said support means also includes ratchet means for adjusting the inclination of said footplates with respect to a substantially horizontal plane.

8. The adjustable wheelchair of claim 7 wherein said ratchet means is for adjusting said inclination from 0° to about 90° with respect to said substantially horizontal plane.

9. An adjustable wheelchair comprising:

a supporting frame having a front, a rear, and a pair of sides defining a seat portion therebetween;

a pair of main wheels rotatably mounted to said frame, and a pair of secondary wheels rotatably mounted to said frame for pivotal movement with respect thereto;

anti-tip means on the rear of said frame for maintaining said wheelchair in an upright position on said wheels when said chair is subjected to front-rear tippng forces, wherein said anti-tip means includes an angled member extending from said frame and at least one wheel rotatably mounted to one end of said member for counteracting the tipping motion of said chair, and wherein said anti-tip means includes means for pivoting said angled member between a first position wherein said member extends from the rear of said frame and a second position wherein said member is substantially within said frame.

10. A width-adjustable children's vertically collapsible wheelchair system providing improved frontal access, the system comprising:

a supporting tubular frame having a front, a rear, a pair of sides defining a seat portion therebeteen, and a plurality of corresponding pairs of crossbars extending from the respective frame sides;

a pair of main wheels rotatably mounted to said frame, and a pair of secondary wheels rotatably mounted to said frame for pivotal movement with respect thereto;

said frame including means for continuous adjustment of the width of said seat portion over a defined range, said width adjusting means includes split clamp means for adjustably joining each of said corresponding pair of crossbars;

a back portion extending generally vertically from said fame, means for collapsing said back portion to a generally horizontal orientation;

a pair of arm rests rotatably connected to said back portion, said collapsing means including means for detachably securing said arm rests to said frame; and supporting means mounted to said frame for supporting the feet of a human, including a pair of footplates swingably mounted to said frame for pivotal movement between a first position wherein said footplates extend outward from frame, and a second position wherein said footplates are oriented toward said frame, first position allowing frontal access to said seat portion without substantial interference from said footplates, and said second position providing foot support for the seated patient.

* * * * *